United States Patent [19]

Lieberman et al.

[11] 3,948,071

[45] Apr. 6, 1976

[54] TENSION CONTROL FOR STRETCH-FORMING MACHINE

[75] Inventors: Robert L. Lieberman, Los Angeles; Dale H. De Mott, Calabasas, both of Calif.

[73] Assignee: DeMott Electronics Company, Van Nuys, Calif.

[22] Filed: Apr. 3, 1975

[21] Appl. No.: 564,677

[52] U.S. Cl. ..... 72/21; 72/296
[51] Int. Cl.[2] ..... B21D 11/04
[58] Field of Search ..... 72/7, 21, 295, 296, 297

[56] References Cited

UNITED STATES PATENTS

| | | | |
|---|---|---|---|
| 2,437,092 | 3/1948 | Greene et al. | 72/296 |
| 2,676,638 | 4/1954 | Wheeler et al. | 72/296 |
| 2,824,594 | 2/1958 | Gray | 72/297 |
| 2,940,499 | 6/1960 | Raynes | 72/296 |

*Primary Examiner*—Lowell A. Larson
*Attorney, Agent, or Firm*—Christie, Parker & Hale

[57] ABSTRACT

A stretch-forming machine in which a work piece is clamped at either end to hydraulic tensioning actuators, the actuators being pivotally supported at the ends of control arms that move the actuators through predetermined arcuate paths relative to a stretch die. The movement of the control arms wraps the work piece around the die while the actuators adjust for differences in the path of the work piece ends and the arcuate path of the control arms. The actuators stress the work piece to maintain it under controlled tension. The actuators are controlled as a function of arm position by cables extending between the center of the die and the pivotal supports of the actuators on the control arms. The cables wrap around the surface of the die as the control arms swing through their arcs. Linear transducers generate output signals that correspond to any changes in length of the cables between the die and the pivot points on the control arms due to the movement of the control arms relative to the die. Control means for the actuators is operated in response to the output of the transducers to control the tension in the work piece.

13 Claims, 3 Drawing Figures

Fig. 3
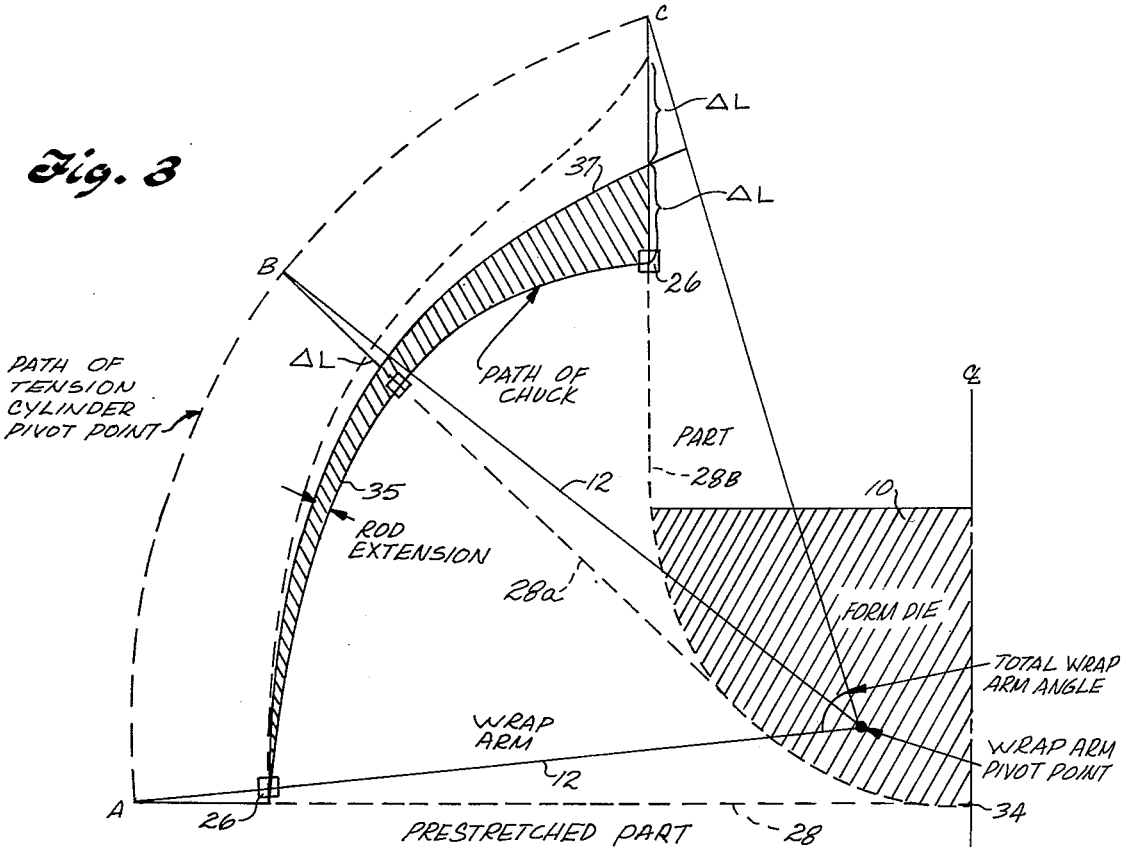
A. START OF WRAP B. INTERMEDIATE POSITION C. FINISH POSITION
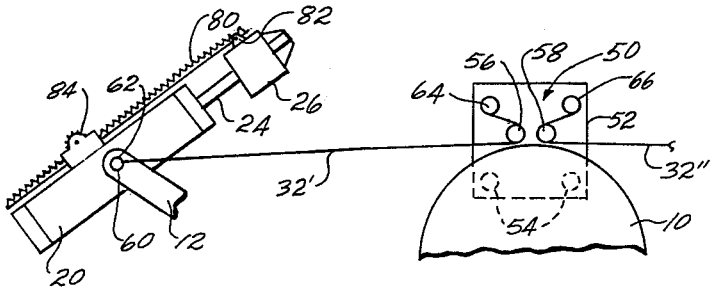
Fig. 4
Fig. 5
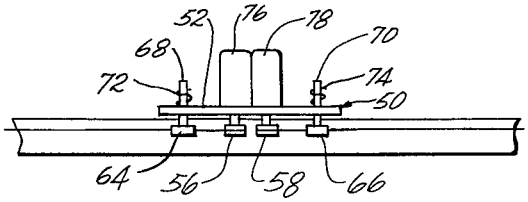

TENSION CONTROL FOR STRETCH-FORMING MACHINE

FIELD OF THE INVENTION

This invention relates to stretch-forming machines, and more specifically, to automatic control of stretch-forming machines.

BACKGROUND OF THE INVENTION

The use of stretch-forming techniques to change the shape of metals is well known. In stretch-forming, the work piece is elongated under tension so that the elastic limit is exceeded, resulting in a permanent deformation of the work piece during the forming process. The summation of stresses due to bending and stretching are sufficient to cause yielding to take place in the material. At the same time, the strain values must not exceed limitations imposed by the ductility of the material. For many materials, the margin between the minimum strain required to effect permanent deformation and the maximum strain permissible to prevent breakage or tearing of the material may be quite small.

A typical stretch-forming machine includes a form die around which the work piece is wrapped under tension to form the work piece into the desired shape. Wrapping is preferably accomplished by a pair of wrap arms, each of which are independently driven through a predetermined path on either side of the die. Hydraulic tension cylinders are pivotally supported on the ends of the arms and are provided with clamping means for gripping the ends of the work piece. The hydraulic cylinders control the tension applied to the work piece while the movement of the control arms causes the work piece to be wrapped around the forming surface of the die.

Various control systems have been devised for maintaining sufficient tension on the work piece to stress the material beyond the yield point without causing material failure. One such system, described in U.S. Pat. No. 2,824,594, is known as the "positive position" control system. This system uses servo control mechanisms to control the positions of the gripping jaws during the wrapping operation. A wire is attached to and wraps around a contoured template mounted above the die as the arms are moved to wrap the work piece around the die. The wire terminates on reels mounted on the gripping jaws. Sensors react to any change in length of the wire to operate the servo units. The servo units control the hydraulic cylinders to maintain the length of the wire between the position sensors mounted on the gripping jaws at a constant length during the wrapping operation. Forming parameters can be modified by varying the contour of the template.

The positive position system has the disadvantage that a separate template must be used for the wire. Moreover the wire must be present during the active forming process. The installation of the template on the press is time consuming, and the template as well as the cable can impede part manipulation and accessibility.

An alternative control system heretofore proposed provides open-ended control of the position of the gripping jaws as a function of control arm position during the wrapping operation. Such a control system includes means for recording the movement of both tension cylinders as a function of angular position of the control arms. Once one piece is formed and the data required is recorded, the recorded data can be played back to control the stretch-forming machine to reproduce additional parts. Such an arrangement has the disadvantage of requiring an actual work piece to be present during the Record mode.

SUMMARY OF THE INVENTION

The present invention is directed to a control system for a stretch-forming machine of the type described in which, in one embodiment, a control cable is anchored at the middle to the center of the forming die and extends around pulleys positioned at the pivotal connection between the respective wrap control arms and the tension cylinders. The ends of the cable, after passing around the pulleys, extend to take-up reels mounted on the jaws which clamp the tension cylinders to the work piece. Linear transducers associated with the reels provide output signals which are indicative of the changes in length of the cable as it is wrapped around the die by arcuate movement of the control arms. The change in length of each half of the cable as a function of the angle of the associated control arm is recorded in digital form in a digital memory. This is referred to as the Record mode. The control arms are then returned to their initial position and the work piece is clamped between the jaws of the respective clamping members on the tensioning cylinders. The tensioning cylinders are then actuated to put the work piece under a predetermined amount of tension. During a Playback mode of operation, the control arms are then again caused to move through the wrap angle and the extension of the hydraulic tension cylinders is varied in accordance with the recorded variations in cable length made during the Record mode. The cable can be removed from the die during the Playback mode of operation. In an alternative embodiment, cables may be anchored at the respective pivot points of the tension cylinder supports with the reels and transducers mounted adjacent the center of the die.

DESCRIPTION OF THE DRAWINGS

FIG. 3 is a diagram showing the tension cylinder extension as a function of wrap control arm angle;

FIG. 4 is a plan view of a stretch-forming machine with an alternative embodiment of the invention;

FIG. 5 is a detailed view of the transducer assembly of FIG. 4; and

DETAILED DESCRIPTION

Figure 1:
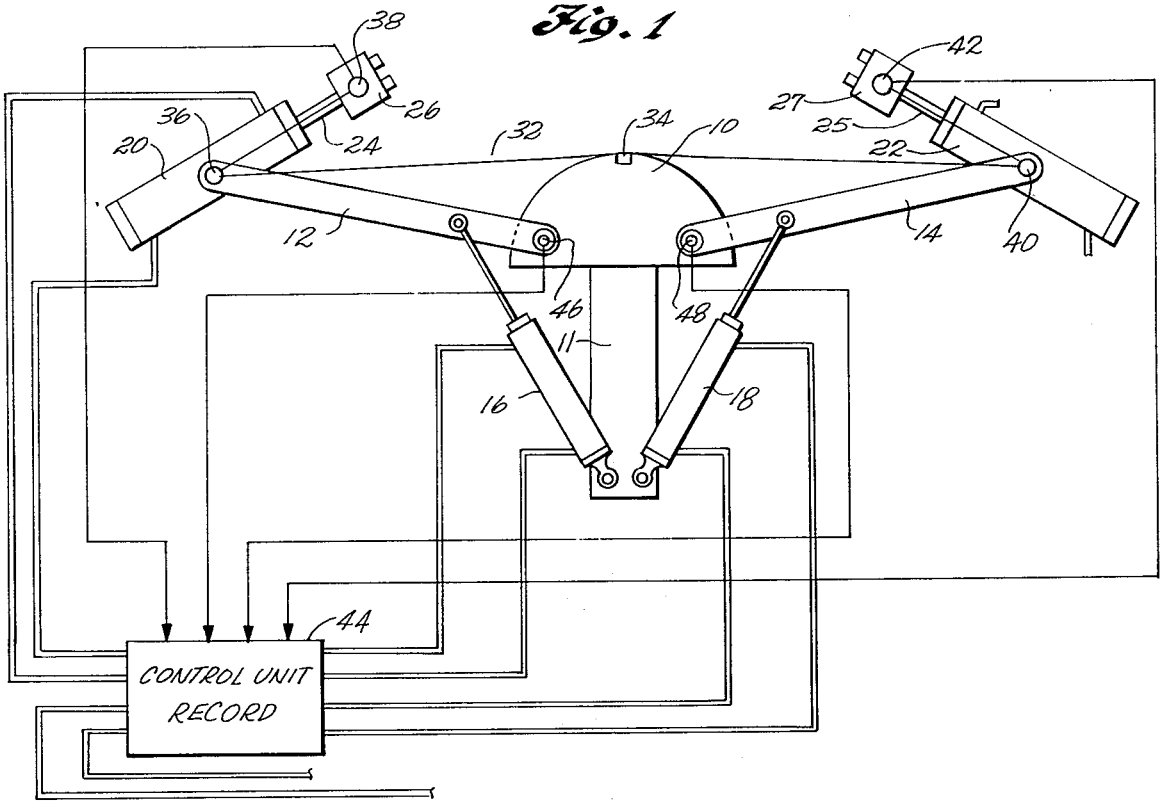
FIG. 1 is a plan view of the stretch-forming machine including a schematic showing of the related controls during the Record mode.

The stretch-forming machine shown schematically in the drawings may be of any well known type construction, such as shown for example in U.S. Pat. No. 2,676,639. In such a stretch-forming machine, a forming die 10 is securely mounted on a suitable base or frame 11 of the machine. A pair of wrap control arms 12 and 14 are pivotally mounted at their inner ends to the frame of the machine. The outer ends of the arms 12 and 14 are rotated by a pair of hydraulic cylinders 16 and 18 which are pivotally connected at one end to the frame of the machine and at the other end to the outer ends of the respective arms 12 and 14. Tension cylinder assemblies 20 and 22 are pivotally supported on the ends of the arms 12 and 14, respectively, so that the tension cylinder assemblies are free to rotate relative to the arms. The tension cylinders include movable rods 24 and 25 on the end of which are mounted chuck or clamping units 26 and 27 adapted to clamp onto and grip the ends of a work piece, such as indicated at 28 in FIG. 2.

The stretch-forming operation is depicted in FIG. 3. This diagram shows the operation for one of the wrap arms, but normally both wrap arms operate in a symmetrical fashion. With the ends of the work piece 28 held in the chucks 26 and 27, the stretch cylinder assemblies 20 and 22 are hydraulically adjusted to prestress the work piece beyond the yield point of the material. The wrap arm 12 is then rotated about its inner pivot, with the outer end of the arm moving through an arc of a circle (the wrap arm 14 is similarly rotated but is not included in the diagram of FIG. 3). This causes the work piece to wrap around the outer forming surface of the die 10. Assuming that it is necessary to maintain the length of the work piece from the center point of the die, as indicated at 34, to the chuck 26 constant in length during the forming operation, the tensioning cylinder 20 must adjust the rod 24 as the angle of the wrap arm changes. Depending upon the shape of the die 10, of course, the desired path of the outer end of the work piece 28 will probably not be an arc of a circle having its center at the inner pivot of the wrap arm, but rather will be some path as indicated at 35 in FIG. 3. The required rod extension is therefore determined by the varying distance of the path 35 relative to the path 37 defined by the chuck if the rod length remained constant. The amount of extension of the chuck 26 with rotation of the arm is measured at each angular position of the arm along a line tangent to the forming surface of the die 10. Three such positions are indicated at 28, 28*a*, and 28*b*.

Figure 2:
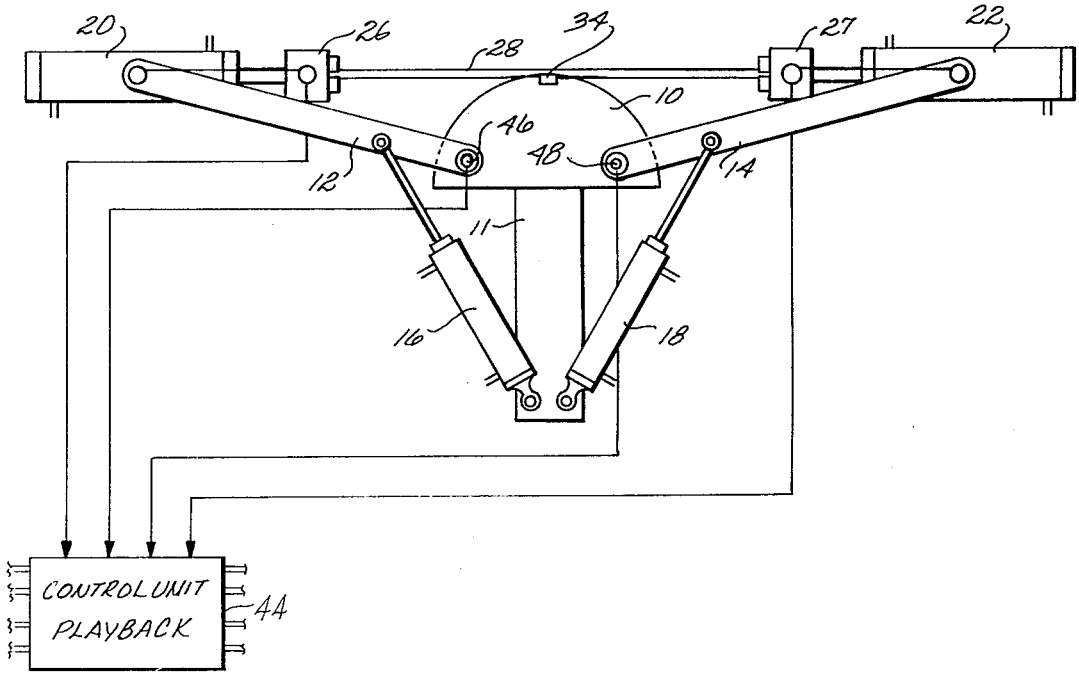
FIG. 2 is a schematic showing of the stretch-forming machine operating in the Playback mode.

In the embodiment of the present invention, as shown in FIGS. 1 and 2, an improved control arrangement is provided in which a cable 32 is initially anchored at its center to the center of the die 10, as indicated at 34. The cable passes through the center line of the pivot support 36 of the tension cylinder assembly 20 on the arm 12. The cable terminates at a reel assembly 38 mounted on the chuck 26 at the end of the cylinder rod 24. The reel assembly may be similar to that described in U.S. Pat. No. 2,824,594 and includes a position transducer for providing a signal that varies with the angular rotation of the reel as the cable 32 is taken up by or winds off the reel.

Similarly the other end of the cable 32 passes around a pulley 40 rotatably mounted at the pivot axis between the wrap arm 14 and the tension cylinder assembly 22. The end of the cable terminates at a reel assembly 42 mounted on the chuck 27 at the end of the cylinder rod 25.

The wrap cylinders 16 and 18 and the tension cylinders 20 and 22 are both operated from a suitable hydraulic pump through control valves which form part of a control unit indicated generally at 44. The cylinders 16 and 18 are operated to rotate the control arms through the desired angle at constant angular rate, for example, or may be controlled manually to move the wrap arms 12 and 14 through the required wrap angle. Transducers, indicated at 46 and 48, are mounted on the inner support pivots for the wrap arms 12 and 14 and provide output signals which are proportional to the angular position of the respective wrap arms 12 and 14.

Automatic operation of the stretch forming machine is provided by mounting the required die 10 in the machine and anchoring the cable 32 to the midpoint 34 of the die 10 surface with the cable 32 in contact with the die forming surface. The cylinders 16 and 18 are then operated, without the work piece in place, to move the wrap arms 12 and 14 through the complete wrap angle of the respective arms. During this time, the tension cylinders 20 and 22 are hydraulically locked so that the rods 24 and 25 do not move in or out. The initial extension of these rods and the initial angle of the tension cylinders relative to the wrap arms is immaterial as long as the extensions and angles do not change as the arms 12 and 14 are swung through their respective wrap angles.

As the arms swing, the cable 32 is wrapped around the forming surface of the die 10. This causes the length of cable between the anchor point 34 and the respective pulleys 36 and 40 to vary, the amount of variation being a function of the shape of the die forming surface. This in turn causes the cable 32 to be paid out or taken up by the reel devices 38 and 42, respectively, thereby generating output signals which are indicative of the variations in the length of the cable due to the wrapping action about the forming die 10.

The control unit 44 includes apparatus for recording the signals during the Record mode of operation. The signals derived from the transducers associated with the reels 38 and 42 and the transducers 46 and 48 may be recorded in analog forms, as for example on magnetic tape, or the analog signals may be converted to digital form and recorded in a digital memory. Thus during the Record mode, information is recorded providing the values of the length of the cable 32 as a function of the angular position of the respective wrap arms 12 and 14.

Once the Record mode is completed, the wrap arms 12 and 14 are returned to their initial position and the cable 32 is removed from the forming die 10. End portions of the cable are then preferably anchored at the respective pulleys 36 and 40 so that variations in the extension of the cylinder rods 24 and 25 operate the transducers in the reel assemblies 38 and 42 to indicate changes in the length of the respective tension cylinders 20 and 22, in a manner hereinafter described in more detail.

As shown in FIG. 2, a work piece 28 is then inserted between the clamping members 26 and 27. The hydraulic tensioning cylinders 20 and 22 are then adjusted manually to place the work piece 28 under sufficient tension to prestretch the work piece beyond the yield point. This establishes the initial condition. With the control unit 44 in the Playback mode, the wrap cylinders 16 and 18 are hydraulically operated to swing the arms 12 and 14 in a manner to wrap the work piece 28 around the contour of the forming surface of the die 10. The signals played back are used to control the movement of the tension cylinders with change in position of the wrap arms by conventional servo controls, such as fully described in the above-identified patent. The signals as played back are compared with the output of the respective transducers to generate error signals that adjust the cylinders, in the manner of conventional closed loop servo systems. A suitable servo for this purpose is described in the above-identified patent. The extension of the rods 24 and 25 is thereby adjusted to change the same incremental amount as a function of arm angle as the recorded change in length of the cable 32 during the Record mode.

By adjusting the tension cylinders with change in angle of the wrap arms by the same amount as the change in length of the cable during the Record mode, the length of the work piece surface in contact with the die is maintained constant as it is wrapped around the die by the rotating wrap arms 12 and 14. This will be apparent from a further examination of FIG. 3. With the cable anchored at point 34 and passing around a pulley which moves along the arc from point A to point B to point C as the wrap arm 12 is rotated, as the wrap arm moves the pulley, the cable is withdrawn from the reel by an amount $\Delta L$. If the rod extension during the Playback mode is by the same $\Delta L$, then the clamping member or chuck 26 moves along the desired path 35. Thus a constant length of the work piece is maintained during the wrap-stretch process from the recorded data made during the Record mode.

It should be noted that a number of advantages are achieved by having the cable pass around the pivots 36 and 40 in passing to the reel assemblies and associated transducers. The principal advantage is that the angle and extension of the tension cylinders during the Record mode is immaterial, since the cable is in effect measuring changes in length relative to the pivot point rather than the position of the clamping member itself. During the Playback mode, the presence of the work piece maintains the tension cylinder aligned with the path of the cable between the anchor point 34 and the respective pivot points of the pulleys 36 and 40. Thus any incremental change in this distance is exactly offset by a corresponding incremental change in the extension of the associated rods 24 and 25 during the Playback mode.

While the invention has been particularly described in connection with operating with a Record and Playback mode, the cable arrangement of FIG. 1 can be utilized during the forming of a work piece to provide a means of maintaining constant length of the work piece using closed loop servos in the manner described specifically in the above-identified U.S. Pat. No. 2,824,594.

An alternative cable arrangement is shown in FIGS. 4 and 5. In this arrangement, a transducer assembly 50 is removably mounted in the center of the forming die 10. The assembly includes a mounting plate 52 which is bolted or otherwise removably secured to the die 10 by bolts 54. Mounted on the plate 52 are a pair of rotatable guide wheels 56 and 58. The guide wheels 56 and 58 are very closely spaced from each other and from the forming surface of the die 10 at substantially the midpoint of the forming die. One end of a cable section 32 has a hook 60 which engages a pin 62 at the pivot axis of the mounting for the tension cylinder 20 to wrap arm 12. The other end of the cable 32' passes around the guide wheel 56 and onto a rotating reel 64. A similar cable 32' has one end hooked to the pivot point between the arm 14 and the tension cylinder 22 (not shown in FIGS. 4 and 5). The other end of the cable 32'' passes around the guide wheel 58 to a reel 66.

As best seen in FIG. 5, the reels 64 and 66 are connected to shafts 68 and 70, respectively, which are journaled in the mounting plate 52. Coil springs 72 and 74 are connected between the shafts and the plate 52 to apply spring bias to the reels, thereby applying tension to the respective cables 32' and 32''. Thus as the arms 12 and 14 rotate, the cables are wrapped on the forming surface of the die 10 and at the same time, the cables are paid out or taken up by reels 64 and 66 under the tensioning action of the springs 72 and 74. The guide wheels 56 and 58 are mounted on the ends of the shafts of a pair of position transducers 76 and 78 for generating a signal indicative of the changes in length of the respective cable during the wrap operation.

To monitor the position of the chucks 26 and 27 with extension of the rods 24 and 25, each tension cylinder is provided with a sensor which includes an elongated rack 80 connected at one end to the chuck 26 by a bracket 82. The other end passes through a transducer unit 84 mounted on the hydraulic cylinder, the rack 80 passing through a guide and engaging a pinion within the transducer 84 for rotating a position transducer by means of which an electrical signal is provided which is proportional to the extended length of the rod 24.

The servo control arrangement for the alternative embodiment of FIGS. 4 and 5 is identical to that described above in connection with FIGS. 1 and 2. Functionally the synchro transformers 76 and 78 replace the transducer units 38 and 42 when operating in the Record mode. When operating in the Playback mode, the assembly 50 and associated cables 32' and 32'' are removed and the work piece 28 inserted between the chucks 26 and 27 in the manner described above. The transducer 84 on the cylinder 20 provides the feedback signal to the servo control, thus functionally replacing the transducer 38 during the Playback mode as described above.

While the arrangement of FIGS. 4 and 5 require separate transducers for sensing cable length during Record and sensing tension cylinder extension during Playback, it has the advantage over the arrangment of FIGS. 1 and 2 in that once the cable assembly is used during the Record mode it can be removed and stored away while the machine is put in production on generating work pieces. The permanent transducer arrangement mounted on the tension cylinders is more rugged and reliable in operation, particularly under the conditions to which the tension cylinders are subjected during the forming operation of the work pieces.

Figure 6:
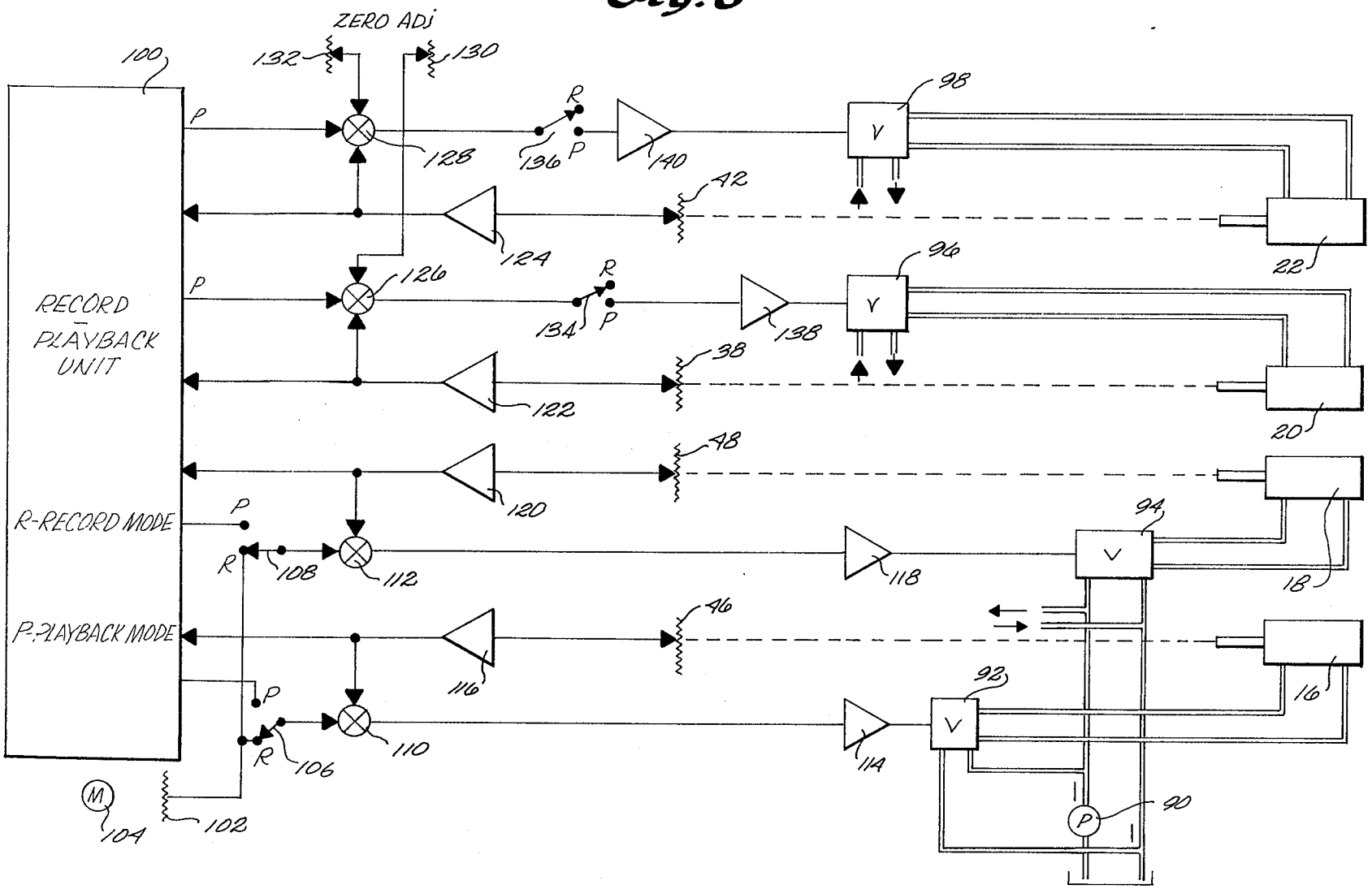
FIG. 6 is a schematic diagram of a servo control system.

Referring to FIG. 6, the control circuit for the stretch-forming machine is shown in more detail. Each of the hydraulic cylinders 16, 18, 20 and 22 is operated from a hydraulic pump 90 which provides hydraulic fluid under pressure to the respective cylinders through servo valves 92, 94, 96 and 98, respectively.

To control the servo valves, the control unit includes apparatus capable of recording and playing back data, as indicated generally at 100. This may be a tape recorder, as in a completely analog control system, or may be a data processor including data storage in a digital control system. If a digital processor is used, it will be understood that suitable analog-to-digital and digital-to-analog converters must be included to convert the signals derived from the transducers to digital form and convert the digital data back to analog signals for controlling the servo valves.

With the Record-Playback unit 100 in the Record mode for the initial run without the work piece, the arms are caused to swing through their full wrap angles. While an open loop control of the cylinders 16 and 18 may be provided, there is shown a closed loop servo control in which a potentiometer 102 is driven by a motor 104 to produce a control signal for the servo valves 92 and 94. The output from the potentiometer 102 is connected through switches 106 and 108, which are set in the R position, to summing circuits 110 and 112. The output of the summing circuit 110 is a servo error signal which is amplified by an amplifier 114 and applied to the servo valve 92. The summing circuit 110 compares the signal from the potentiometer 102 with the output of the transducer 46. The latter is amplified by suitable amplifier 116, the output of which is applied to the summing network 110. Any difference in magnitude of the two inputs to the summing network 110 causes adjustment of the valve 92 to reduce the error signal to zero, in the manner of conventional feedback servo controls. The output of the amplifier 116 is also applied to the Record-Playback unit 100 where the signal information is stored.

Similarly, the output of the summing network 112 is amplified by an amplifier 118 and applied to the servo valve 94. The summing network compares the input from the potentiometer 102 with the output of the transducer 48 as amplified through a suitable amplifier 120. The output of the amplifier 120 is also recorded during the Record mode of the Record-Playback unit 100. Thus as the motor 104 causes the signal from the potentiometer 102 to vary at a constant rate, the hydraulic cylinders 16 and 18 cause the arms 12 and 14 to swing through their full operative arc, thereby causing the cable 32 to be wrapped about the die 10 in the manner described above. Since the tensioning cylinders 20 and 22 are not controlled during the Record mode, no servo operation of the valves 96 and 98 takes place. However, the output signals from the transducers 38 and 42, respectively, are amplified through amplifiers 122 and 124 and applied to the Record-Playback unit 100 for storage.

During the Playback mode the hydraulic cylinders 16 and 18 may be controlled in response to the potentiometer 102 or may be controlled from the recorded signal by means of the switches 106 and 108 which are set to the Playback position. The latter arrangement is preferable where the analog signals are recorded on four separate channels on tape and played back simultaneously.

During the Playback mode, the signals derived from the transducers 38 and 42 during the Record mode are reproduced and applied to one input of respective summing networks 126 and 128 where they are compared with the feedback signals from the amplifiers 122 and 124, respectively. Also applied to the summing networks 126 and 128 are Zero adjustment signals derived from potentiometers 130 and 132. The latter allow the tension cylinders 20 and 22 to be adjusted initially to put any desired prestress into the work piece 28.

The error signals derived at the outputs of the summing networks 126 and 128 are coupled respectively through switches 134 and 136 and through amplifiers 138 and 140 to the servo valves 96 and 98 for controlling the tensioning cylinders 20 and 22, in the manner described above in detail.

What is claimed is:

1. A control system for a stretch-forming machine of the tape having a forming die and at least one rotating arm with a tension cylinder pivotally mounted on the arm at a pivot point, the tension cylinder moving a chuck for gripping the end of a work piece to wrap the work piece around the die by rotation of the arm, the control system comprising:

a flexible member extending between the tension cylinder pivot point on the arm and a point on the surface of the die, the flexible member being wrapped around the surface of the die by rotation of the arm, means for adjusting the length of the flexible member as the distance between the tension cylinder pivot point and said point on the die varies with rotation of the arm, first transducer means coupled to the flexible member for generating an output signal that varies in response to changes in the length of the flexible member between the tension cylinder pivot point on the arm and said point on the die, and control means responsive to the signal from the first transducer means for controlling the tension cylinder to adjust the position of the chuck relative to the tension cylinder pivot point with changes in the position of the arm.

2. Apparatus of claim 1 wherein said means for adjusting the length of the flexible member includes means positioned on the chuck for applying tension to the flexible member while allowing the flexible member to move longitudinally relative to the chuck, one end of the flexible member being anchored to the die at said point, and guide means at the tension cylinder pivot point on the arm, the flexible member passing around the guide means in passing from the chuck to the die.

3. Apparatus as defined in claim 1 wherein one end of the flexible member is anchored at the pivot point on the arm, said means for adjusting the length of the flexible member including a reel mounted in fixed relation to the die on which the flexible member is wound, the first transducer means being mounted adjacent to and in fixed relation to the die, and means actuating the first transducer means in response to winding of the flexible member on and off the reel.

4. Apparatus of claim 1 wherein said means for adjusting the length of the flexible member includes means positioned at said point on the die for applying tension to the flexible member while allowing the tension member to move longitudinally relative to the die.

5. Apparatus of claim 4 wherein the first transducer is mounted adjacent to and in fixed relation to the die for sensing the longitudinal movement of the flexible member relative to the die.

6. Apparatus of claim 1 further including second transducer means coupled to the arm for generating an output signal that varies in response to changes in position of the arm, the control means including means for storing the signals from said first and second transducer means during a first rotation of the arm, and means for subsequently reproducing the signals to control the tension cylinder during subsequent rotation of the arm.

7. A stretch-forming machine comprising a die having a work forming surface, means for gripping a work piece, means for moving the gripping means relative to the die including a driven member movable through a predetermined path relative to the die, and adjustable tensioning means coupling the gripping means to the driven member for applying tension to a work piece held in the gripping means, an elongated flexible nonelastic element extending from the driven member around the work forming surface of the die, means for adjusting the length of the flexible element as the driven member is moved relative to the die, said means including means for maintaining the element under tension during movement of the driven member, and means including a transducer responsive to variations in the length of the flexible element between the die and the driven member for controlling the tensioning means when a work piece is present to limit the stretching of the work piece during the forming operation.

8. Apparatus of claim 7 wherein the transducer is mounted adjacent to and in fixed relation to the die.

9. Apparatus of claim 7 wherein said means for controlling the tensioning means includes means for storing and reproducing the output of the transducer.

10. Apparatus of claim 7 wherein the flexible element passes around a guide on the driven member to the gripping means, the transducer being mounted on the gripping means, whereby both relative movement between the driven member and the gripping means and between the driven member and the die change the effective length of flexible element as sensed by the transducer.

11. A stretch-forming machine comprising a die member, a spaced pair of work clamping means for a holding work piece, tensioning means for moving said clamping means relative to each other in a direction to apply tension to the work piece, movable support means pivotally connected to said tensioning means for moving the pivoted connection with the tensioning means through a predetermined path, a flexible member having a portion connected to the die member, the die member having a contoured surface over which the flexible member passes, a displacement transducer, guide means directing the flexible member substantially through the pivot axis of the connection between the support means and the tensioning means to the displacement transducer, the transducer providing an output signal proportional to displacement of the flexible member relative to the transducer.

12. Apparatus of claim 11 wherein the tensioning means is free to pivot on the movable support means and the transducer is mounted on the work clamping means.

13. Apparatus of claim 11 further including means for recording changes in the output of the transducer with movement of the support means through said predetermined path.

* * * * *